United States Patent [19]

Porter et al.

[11] 4,207,362

[45] Jun. 10, 1980

[54] METHOD OF AND APPARATUS FOR WIPING HOT DIPPED METAL COATED WIRE OR STRIP

[75] Inventors: Maxwell R. Porter, Ermington; Jack P. Sciffer, New Lambton; Zigmunt P. Adamiak, Kotara; Alexander Dim, Speers Point, all of Australia

[73] Assignee: Australian Wire Industries Proprietary Limited, Victoria, Australia

[21] Appl. No.: 958,602

[22] Filed: Nov. 8, 1978

[30] Foreign Application Priority Data

Nov. 21, 1977 [AU] Australia ..... PD2481

[51] Int. Cl.[2] ..... C23C 1/02

[52] U.S. Cl. ..... 427/367; 427/432; 427/433; 118/103; 118/123; 118/125; 427/434.4; 427/434.6

[58] Field of Search ..... 427/367, 433, 434 B, 427/349, 434 D, 431, 432, 357; 118/123, 125, 103

[56] References Cited

U.S. PATENT DOCUMENTS

| | | | |
|---|---|---|---|
| 2,868,159 | 1/1959 | Lit et al. | 118/125 |
| 3,274,027 | 9/1966 | Nickola et al. | 427/434 B |
| 3,513,018 | 5/1970 | Taylor | 427/367 |
| 3,607,366 | 9/1971 | Kurokawa | 427/431 |
| 3,681,118 | 8/1972 | Ohama et al. | 427/431 |
| 3,738,861 | 6/1973 | Sciffer et al. | 427/433 |
| 3,892,894 | 7/1975 | Sciffer | 427/367 |

*Primary Examiner*—Ralph S. Kendall

*Attorney, Agent, or Firm*—Cushman, Darby & Cushman

[57] ABSTRACT

A method of wiping hot dipped metal coated wire or strip, and an apparatus for performing the method, involving drawing the wire or strip upwardly from a bath of molten metal through a wiping bed located at the point of emergence from the bath, with an interference device being positioned adjacent the wire or strip below the surface of the molten bath such as to restrict the lamella flow of molten metal entrained by the moving wire or strip. The interference device wholly or partly surrounds the wire or strip and is located below the wiping bed, which bed in turn may be laterally confined or unconfined. The interference device may be of any convenient configuration such as in the form of a horizontally disposed flat plate provided with one or more slots, grooves or other apertures through which the wire or strip passes.

15 Claims, 8 Drawing Figures

Figure 1:
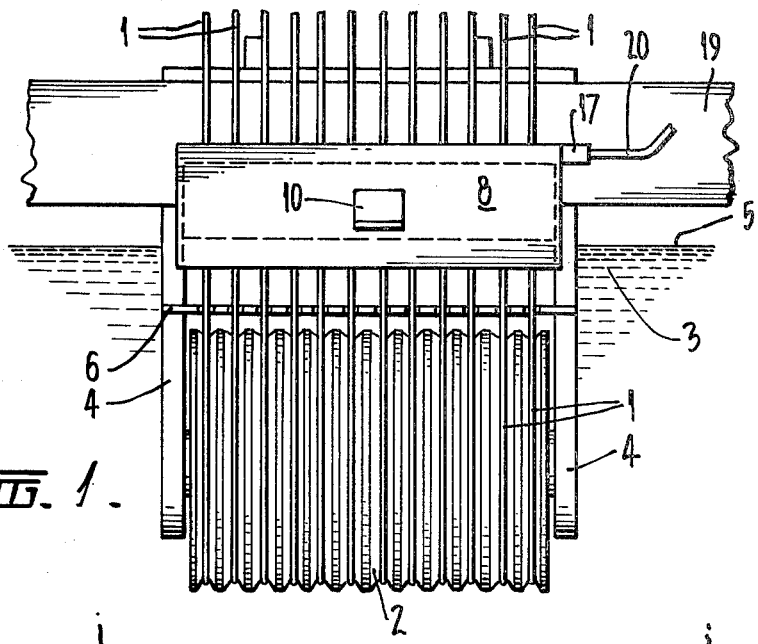

FIG. 4.
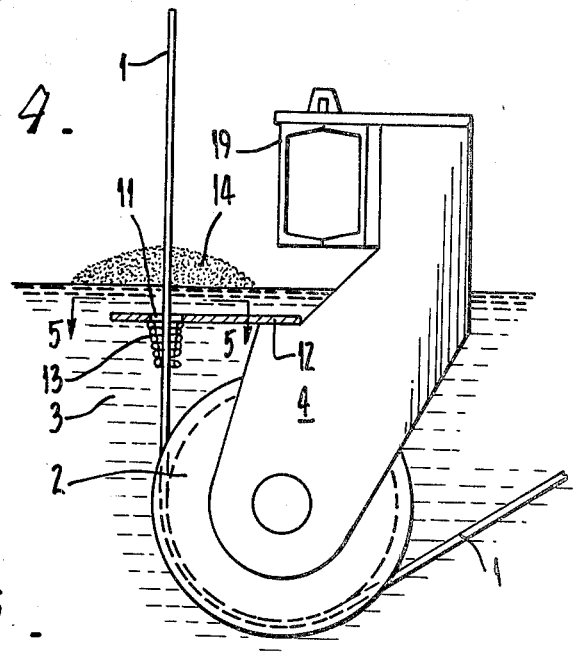
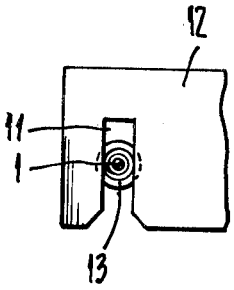
FIG. 5.
FIG. 6.
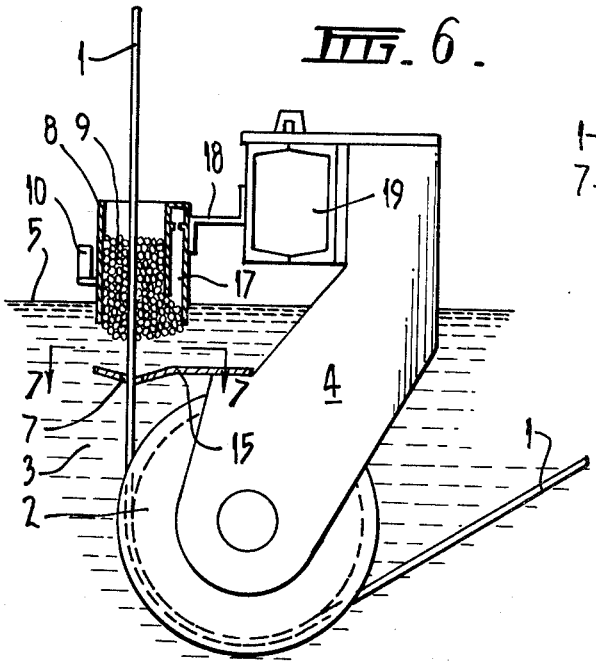
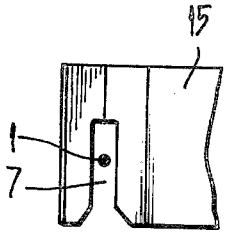
FIG. 7.

METHOD OF AND APPARATUS FOR WIPING HOT DIPPED METAL COATED WIRE OR STRIP

This invention relates to an improved method and apparatus for use in the operation of wiping hot-dipped metal-coated wire or strip by drawing it upwardly from a bath of the molten coating metal through a wiping bed of particulate or discrete material which preferably floats on the molten metal. The invention is concerned primarily with the production of galvanised wire or strip, but is not restricted thereto, as coating metals other than zinc may be used.

For many years it has been conventional, in the production of galvanised wire or strip, to draw the wire upwardly from the bath of molten zinc through a laterally unconfined wiping bed composed of oiled crushed charcoal, though other particulate materials, including coke, sand and vermiculite, have also been proposed or used.

In the specification of our prior Australian Pat. No. 421,751, we have disclosed the use of a laterally confined wiping bed formed of free tumbling bodies composed of hard and inert material, such as river gravel, this bed being permeated by a non-oxidising gas containing at least a small proportion of Hydrogen Sulphide. By means of this method it has been possible not only to increase, significantly, the drawing speed or production rate, but also to produce coatings of improved quality. This improved wiping method is now commonly termed "gas wiping."

We have also found that by vibrating the wiping bed, as disclosed in our Australian Pat. No. 477,914, still higher production rates and increased uniformity can be achieved by this gas wiping procedure.

While substantial increases in drawing speed of the wire or strip have been achieved with the gas wiping process, a limit is ultimately reached at which long term continuous control of coating weight is rendered difficult.

As throughput speed of the wire or strip is increased, various wiping methods fail in different ways. For example, in the oiled charcoal wiping method the coating become excessively heavy and rough; in the gas wiping method a limit is reached due to solidification of the coating metal in the particulate bed, resulting in the loss of control of coating weight.

We have found that the main or ultimate cause of the limitation in each case is due to the increasing upthrust of the molten metal flow carried by the moving wire or strip into the wiping bed. As the wire or strip moves through the molten coating metal, shear forces between the moving wire or strip and the liquid metal produce viscous forces which cause a surrounding column of coating metal to be moved through the bath metal with the wire or strip and to impinge on the withdrawal area where the wire emerges from the bath and enters the wiping bed.

It is the general object of this invention to provide further improvements in the method of and apparatus for wiping hot-dipped, metal-coated wire or strip using a wiping bed of particulate or discrete material. A further object is to provide means whereby the range of throughput speed of the wire or strip, over which effective coating control may be obtained, is extended.

This invention envisages a method of wiping hot-dipped metal-coated wire or strip by drawing it upwardly through a wiping bed of particulate or discrete material, which method comprises obstructing, and thus reducing, the flow of molten metal which tends to be carried along by the wire or strip as it moves through the said bath and into the bottom of the wiping bed. Preferably the particulate or discrete material may be charcoal, coke, sand, gravel, vermiculite or other suitable material. The particulate material in the wiping bed may be laterally confined or laterally unconfined. The wiping bed preferably floats on the bath of molten metal, and its lower end may be submerged below the surface of the molten metal.

The art of using baffles to minimise turbulence caused by the moving wire on the molten metal bath is disclosed by B.I.C.C. in British Pat. No. 1,030,967. However the effects produced by the apparatus described herein are distinctly different in that the present invention deals with, and seeks to control, the entrained lamella flow region immediately adjacent to the moving wire whereas the invention disclosed in the aforesaid patent deals with the bath turbulence. This fact is reinforced by the non-specific data on dimensions and placement.

The invention also envisages an apparatus comprising an interference device which wholly or partly surrounds the wire or strip and which is arranged within the bath below the wiping bed thereby to obstruct and so reduce the flow of molten metal into the wiping bed. Preferably the interference device is arranged close to the bottom of the wiping bed. The interference device may comprise any suitable means which will modify the fluid flow below the surface of the molten metal in the bath so as to reduce the vertical component of such flow.

The interference device may be of any design or configuration which will achieve the desired flow reduction, and may comprise, for example but without limitation, an interference plate located, preferably in a horizontal or substantially horizontal plane, in a zone extending from the bottom of the particulate wiping bed to a point within the bath of molten metal and not more than a pre-determined distance (e.g., 150 mm) below the surface of the molten metal. The distance the wire or strip and entrained layer may run without interference in the molten metal between the interference device and wiping bed is preferably not more than 50 mm.

The interference plate may be provided with one or more slots, grooves or other apertures through which the wire or strip passes. The slots or other apertures may be parallel-sided, V-shaped, circular, part circular, or of any other suitable shape when viewed in plan, and may partly or wholly surround the wire. A clearance is provided between the sides of the slot or apertures and the periphery of the wire or strip. The said clearance is preferably in the range, particularly for zinc coatings, of 2 to 26 times the ultimate coating thickness sought. The clearance value is generally dependent on the viscosity and density of the molten coating material, and as such it will be appreciated that a certain best particular clearance value, or range of clearance values, could be found for particular coating materials.

The width of the slot relative to the wire diameter is calculated by means of the following formula:

$$W=D+XT$$

where

W=slot width

D=wire diameter or strip thickness

X = variable numeral from 2 to 26 inclusive

T = coating thickness of final product

The optimum width of slot for any individual installation is best determined by experimentation.

Interference devices or other designs and configurations, which may partially or wholly surround the wire or strip, and which may be disposed in any suitable manner and at any desired position or inclination within the bath, so as to control the fluid flow in relation to the upwardly moving wire or strip, may be employed and are within the scope of this invention.

The interference device may be provided with one or more apertures which may surround or partly surround a plurality of wires or strips which are being drawn in parallel. When multiple wires or strips are coated in parallel, the interference device may comprise, for example, a plate having a series of parallel open-ended slots each of which partly surrounds a wire or strip, the said plate having a comb-like appearance when viewed in plan.

It will be understood that the interference device of this invention contributes to but does not provide the ultimate control of coating weight; this is still provided by the wiping technique employed, preferably by a gas wiping technique as described in our Australian Pat. Nos. 421,751 and 477,914.

An additional benefit achieved by limiting the upthrust of the column of entrained coating metal in accordance with the invention is a reduced standard deviation, i.e., less scatter of results in the weight of coating on the wire or strip. This is because the ultimate coating control mechanism is not called upon to cope with the large forces resulting from other techniques.

A further advantage obtained by the use of the invention is a reduction in the mean coating weight because of the less frequent bed maintenance required.

One still further result of the use of the technique of this invention is a decrease in the effect of wire unsteadiness. Wire unsteadiness is undesirable, especially at high speeds, and, with known technology, results in heavy coatings. It is believed that the reduced vertical flow rate of the entrained column will result in a lower coating weight and thus reduce the effect of wire unsteadiness on the coating weight.

A still further advantage of the invention is that its use, when allied with the aforementioned gas wiping process, reduces the necessity for maintenance of the particulate wiping bed due to the reduction of the upthrust forces which lead to the intrusion of the coating metal into the bed.

Figure 2:
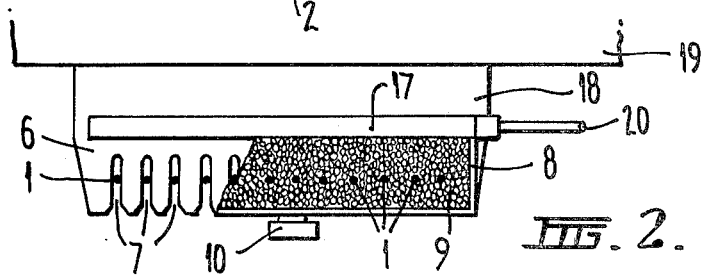
Figure 3:
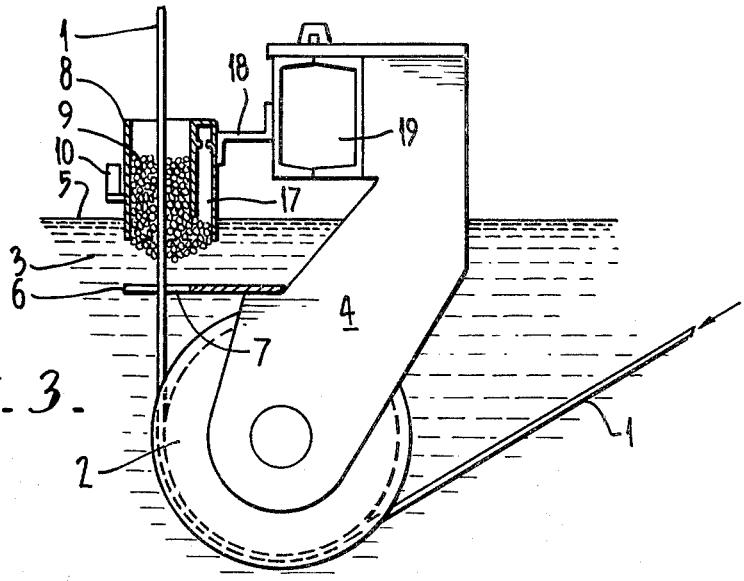
Figure 8:
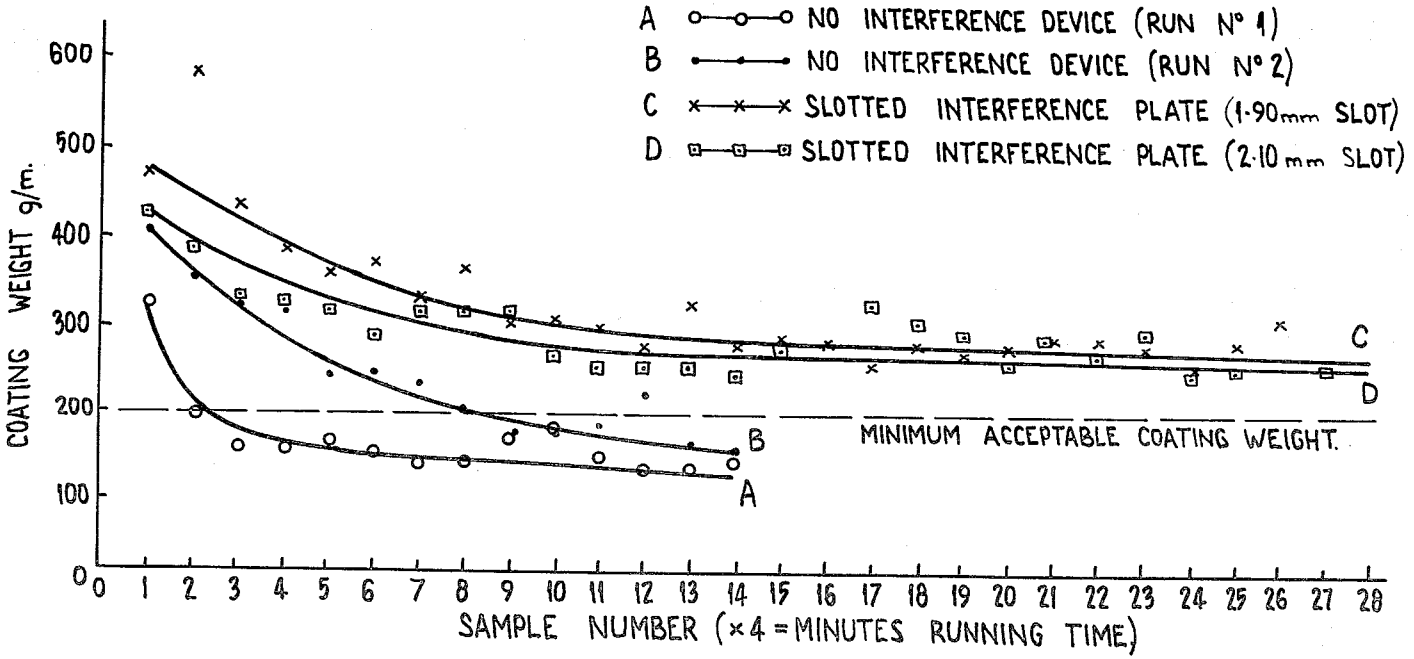

The object and advantages of the invention are illustrated by the ensuing description of embodiments shown in the accompanying drawings, to which the invention is in no way limited. In these drawings:

FIG. 1, is a diagrammatic front elevational view of one form of apparatus in accordance with the invention and for carrying out the method of the invention, and as applied particularly to wiping multiple wires or strips, FIG. 2, is a diagrammatic plan view partly sectioned of the apparatus of FIG. 1, FIG. 3, is a diagrammatic side elevational view partly sectioned of the apparatus shown in FIGS. 1 and 2, FIG. 4, is a diagrammatic side elevational view partly sectioned of a modified form of the apparatus shown in FIGS. 1 to 3, FIG. 5, is a diagrammatic plan view of part of the interference device shown in the embodiment of FIG. 4, FIG. 6, is a diagrammatic side elevational view partly sectioned of a further modified form of the apparatus, FIG. 7, is a diagrammatic plan view of part of the interference device shown in the embodiment of FIG. 6, and FIG. 8, is a graph showing the comparison between the coating weight of successive samples of wire, taken at 4 minute intervals, after being coated (1) without the use of an interference device, and (2) by means of the apparatus shown in FIGS. 1 to 3 and 6 and 7, and employing an interference device in accordance with the invention.

In the drawings FIG. 1 is a diagrammatic front view of the apparatus in accordance with one embodiment of the invention and FIG. 2 and FIG. 3 are diagrammatic views in plan and in side elevation respectively.

In these drawings a multiple wire or strip embodiment is illustrated in which the numeral (1) indicates the wires being drawn around a grooved roller (2) and vertically upwards through a bath of molten coating metal (3). The wires (1) pass vertically through an interference device which is attached horizontally to the roller support plates (4) at the desired distance below zinc surface level (5). The interference device comprises a horizontal plate (6) having formed in it slots (7), aligned with a respective groove around the roller, and through which the wires pass, the wires (1) being spaced from the sides or edges of the slots by 2 to 26 times the thickness of the coating desired. As an alternative to a grooved roller such as (2), a fixed body having a grooved arcuate surface may be utilised.

After passing through the interference device the wires (1) continue vertically upwards passing through the gas box (8) containing the wiping bed (9) and gas atmosphere which is fed into the gas box via a side manifold chamber 17 fed by a gas feed line 20. In the embodiment depicted in FIGS. 1 to 3 the interference device is being used in conjunction with a gas wiping installation using a wiping bed of river gravel or similar material which penetrates below zinc level by a distance determined by its S.G. and the height of the bed. Preferably this type of wiping bed is kept compacted and uniform by a vibrator (10), and the gas box is supported by brackets 18 from the main support structure beam arrangement 19 from which the roller 2 is suspended via the support plates 4.

In the modified arrangement of the invention being used in conjunction with a laterally unconfined bed of particulate material, such as a charcoal wiping bed represented diagrammatically in FIGS. 4 and 5, the wire (1) passes around a roller (2) and vertically upwards through the bath of molten metal (3). The wires pass vertically through slots (11) cut in a horizontal plate (12) positioned at the desired distance below zinc surface level (5). The interference device, represented in this case by a helix of wire (13) but which may be of any suitable form or material, for example vertically aligned metal cylinders, refractory ceramic beads or discs, surrounds the wire (1) and is pulled upwards against the horizontal plate (12) by the passage of the wire (1).

It should be noted that in this case the horizontal plate (12) acts only as a rest or location point for the interference device (13) and does not itself act as an interference device (as distinct from the other manifestations shown).

The wire (1) then passes, still vertically upwards, through the bed of oiled charcoal (14) and eventually to the plant take-up.

In the further modified arrangement shown in FIGS. 6 and 7, the arrangement is for a single wire installation, although it should be understood that the other embodiments are also capable of application in the form of a single wire installation. Futhermore the modified arrangement of FIGS. 6 and 7 is equally applicable to multiple wire or strip applications. In this modified embodiment the interference device is formed from a plate having V shaped corrugations with the slot (7) through which the wire (1) passes cut along the corrugation. The figure shows the slotted plate (15) shaped with its two side sections inclined downwardly from their outer edges to the edges of the slot (7) so as to form an upwardly facing shallow V. The angle of each side section of the plate to the horizontal in this arrangement is preferably between 5° and 35°.

In like manner a similar downwardly facing shallow V could be used. In a multi-wire situation the slot arrangement is more conveniently positioned as in the plan view of FIG. 2.

EXAMPLE 1

Using the apparatus of the form shown in FIGS. 1 to 3, a flat interference plate (6) is located in the horizontal plane within the molten zinc bath (3) in a zone extending from the bottom of the particulate wiping bed (9) to a point not exceeding about 150 mm below the zinc surface (5). The clearance between the wires (1) and the sides of the slots (7) is in the range of 2 to 26 times the ultimate coating thickness sought.

The improvements obtained by the use of the interference technology of this invention with the gas wiping process are shown by the results of work done in which a 1.27 mm wire was galvanized at a speed of 180 m/minute with and without an interference device. When no interference device was used, the coating weight fell below the BSS.443 specified minimum after 8 minutes and 30 minutes (two tests).

However, when an arrangement as shown in FIGS. 1 to 3 is used, in which a 1.27 mm wire (1) was withdrawn vertically at a speed of 180 m/minute through the gas/gravel box and wiping bed (9) which had a 3 mm plate (6) with a slot (7) of 1.90 mm width positioned approximately 10 mm below the bottom of the gravel bed (9), it was found (as will be seen from the graphical representation of the results shown in FIG. 8 that the coating weight did not fall below the BSS.443 specified minimum even after some 120 minutes. Without an interference device such a result is attainable only at lower speeds (approx. 90 m/minute maximum) which is an indication of the increased stability given to the wiping bed by the technique of this invention.

EXAMPLE 2

With the modified apparatus of FIGS. 4 and 5, a substantial plate (12) of 9 mm thickness, with 6 mm slots (11) was provided, through which the wires (1) ran. This plate (12) was positioned so that the slots (11) were located in the running position of each wire (1) and at the desired depth below zinc surface level (5). A wire helix (13) made of very soft wire of gauge similar to the running wire (1) was wound around the running wire (1) before the wire entered the zinc bath (3). The diameter of the helix (13) was about 12 mm and it was pulled through by the wire (1) until it rested under and against the slot (11) in the 9 mm plate (12), so providing the interference device.

In one example of this embodiment, a wire of 2.50 mm diameter was drawn upwards through a bed (14) of oiled charcoal at a speed of 15 m/minute and a coating weight of 300 g/m$^2$ was obtained. When an interference device as described above (FIGS. 4 and 5) was used, the 2.50 mm wire (1) was drawn upwards at a speed of 22 m/min. through the charcoal bed (14). The 9 mm plate (12) with a 6 mm wide slot (11) was positioned with the top of the plate 3 mm below the zinc surface (5). The wire helix (13) was wrapped around the 2.50 mm wire and pulled up against the bottom of the plate (12). The coating weight obtained using this arrangement was 300 g/m$^2$, thus showing that the speed range over which effective control can be maintained can be substantially extended by means of this invention.

EXAMPLE 3

With the further modified apparatus of FIGS. 6 and 7 utilising the "V" shaped corrugation (15) with a slot (7) of the desired width at the bottom of the "V," as shown, a 2.10 mm slot (7), was positioned with the slot approximately 10 mm below the bottom of the gravel wiping bed (9). When a 1.27 mm wire was run at 180 m/minute through this apparatus the coating weight (as will be seem from the graphical representation of the results shown in FIG. 8) did not fall below the BSS.443 specified minimum over a period of approximately 120 minutes.

The graph of FIG. 8 shows the coating weight of successive coated wire samples taken at 4 minute intervals under the conditions set out above in Examples 1 and 3 and the graph illustrates the effectiveness of the flow interference device at high speeds, in maintaining effective control of the coating weight, over extended periods with less frequent maintenance of the particulate wiping bed compared with existing technology.

What is claimed is:

1. A method of continuously wiping hot dipped metal coated wire or strip by withdrawing said wire or strip vertically upwards from a bath of molten metal through a wiping bed located at the point of emergence, characterised by the positioning of a static interference device adjacent the wire or strip below the surface of the molten metal bath and below and spaced from said wiping bed, said spacing not exceeding 50 mm, and such that it restricts the lamella flow of molten metal entrained by the moving wire or strip.

2. The method according to claim 1 wherein the clearance between the wire or strip and interference device is between 2 and 26 times the thickness of the desired ultimate coating.

3. The method according to claim 1, wherein the interference device is formed by a parallel sided, "V" shaped, circular, part circular or when viewed in plan and which may partly or wholly surround the wire.

4. The method according to claim 1, wherein the wiping bed is a gas wiping bed.

5. The method according to claim 1, wherein the wiping bed is a laterally unconfined bed of particulate material.

6. The method according to claim 5, wherein the unconfined bed of particulate material is a bed of oiled charcoal.

7. An apparatus for continuously wiping hot dipped metal coated wire or strip, comprising a static interference device which wholly or partly surrounds the wire or strip and is arranged within the bath of molten coating metal and below and spaced from a wiping bed located at the point of emergence, said spacing not exceeding 50 mm, whereby said device restricts the lamella flow of molten metal entrained by the moving wire or strip.

8. The apparatus according to claim 7 wherein the interference device is a flat plate having at least one parallel sided slot formed therethrough.

9. The apparatus of claim 7, wherein a plurality of parallel side slots are provided through said plate to accommodate a plurality of wires or strip.

10. An apparatus according to claimm 8 which the plate is corrugated and the slot or slots are formed in the hills and/or valleys of the corrugations.

11. An apparatus according to claim 7 in which the interference device is a wire helix, refractory bead, or metallic cylinder which surrounds said wire.

12. An apparatus according to claim 11, wherein the wire helix, refractory bead, or metallic cylinder is held in place against a locating plate by the viscous forces associated with the liquid entrained by the running wire or strip.

13. An apparatus as claimed in claim 7, wherein the wiping bed is contained in a gas box into which a gas atmosphere is fed.

14. An apparatus as claimed in claim 7, wherein the wiping bed is a laterally unconfined bed of particulate material.

15. An apparatus as claimed in claim 14, wherein the unconfined bed of particulate material is a bed of oiled charcoal.

* * * * *